US008226023B2

(12) United States Patent
Vuorio et al.

(10) Patent No.: US 8,226,023 B2
(45) Date of Patent: Jul. 24, 2012

(54) REFINER

(75) Inventors: Petteri Vuorio, Valkeakoski (FI); Dahn Lundell, New Westminister (CA); Eric Hensley, Spokane, WA (US); Jeff Bowie, Suwanee, GA (US); Christer Hedlund, Katrineholm (SE); Peter Bergqvist, Skogås (SE)

(73) Assignee: Metso Paper, Inc. (FI)

( * ) Notice: Subject to any disclaimer, the term of this patent is extended or adjusted under 35 U.S.C. 154(b) by 250 days.

(21) Appl. No.: 12/679,628

(22) PCT Filed: Sep. 25, 2008

(86) PCT No.: PCT/FI2008/050536

§ 371 (c)(1),
(2), (4) Date: Jun. 18, 2010

(87) PCT Pub. No.: WO2009/040476

PCT Pub. Date: Apr. 2, 2009

(65) Prior Publication Data

US 2010/0270411 A1 Oct. 28, 2010

(30) Foreign Application Priority Data

Sep. 28, 2007 (FI) ..... 20075684

(51) Int. Cl.
*B02C 7/12* (2006.01)

(52) U.S. Cl. ..... 241/261.3; 241/298

(58) Field of Classification Search ..... 241/261.2, 241/261.3, 296, 297, 298

See application file for complete search history.

(56) References Cited

U.S. PATENT DOCUMENTS

| | | | |
|---|---|---|---|
| 4,023,737 | A | 5/1977 | Leider et al. |
| 4,253,613 | A | 3/1981 | Reinhall |
| 5,425,508 | A | 6/1995 | Chaney |

FOREIGN PATENT DOCUMENTS

| | | | |
|---|---|---|---|
| EP | 0 611 599 | B1 | 8/1994 |
| EP | 0 958 058 | B1 | 11/1999 |
| WO | WO 97/18037 | | 5/1997 |

(Continued)

OTHER PUBLICATIONS

International Preliminary Report on Patentability of corresponding international Application No. PCT/FI2008/050536, completed Nov. 3, 2009.

(Continued)

*Primary Examiner* — Mark Rosenbaum
(74) *Attorney, Agent, or Firm* — Alston & Bird LLP

(57) ABSTRACT

A refiner (1) comprising a stator (2) and a rotor (4). The stator (2) and the rotor (4) comprise a flat portion (7, 9) and a conical portion (8, 10). The conical portion has a first end (17) of smaller diameter (D1) and a second end (18) of greater diameter (D2) such that the first end is directed towards the flat portion and the second end is directed away from the flat portion. The refining surface (12) of the conical portion of the stator comprises at least an outer zone (23) arranged at the second end of the conical portion and an inner zone (22) arranged relative to the outer zone on the side of the first end of the conical portion. A portion of the length of the blade bars (20) in the outer zone are arranged relative to the rotation direction (RD) of the rotor such that they have a retentive effect on the material to be refined. Also a blade segment (19) for a conical portion of a stator of a refiner.

19 Claims, 5 Drawing Sheets

FOREIGN PATENT DOCUMENTS

WO WO 2007/085703 A1 8/2007

OTHER PUBLICATIONS

International Search Report of corresponding international Application No. PCT/FI2008/050536, completed Dec. 9, 2008.

Written Opinion of corresponding international Application No. PCT/FI2008/050536, completed Dec. 9, 2008.

Demand and Comments in response to the Written Opinion of corresponding international Application No. PCT/FI2008/050536.

Office Action dated Jul. 11, 2008 of corresponding Finnish Application No. 20075684.

A - A

REFINER

CROSS REFERENCE TO RELATED APPLICATIONS

This application is a national stage application, filed under 35 U.S.C. §371, of International Application No. PCT/FI2008/050536, filed Sep. 25, 2008, which claims priority to Finnish Application No. 20075684, filed Sep. 28, 2007, both of which are hereby incorporated by reference in their entirety.

BACKGROUND OF THE INVENTION

1. Field of Invention

The invention relates to a refiner comprising a stator and a rotor, the stator and the rotor comprising a flat portion and a conical portion, the conical portion having a first end of smaller diameter and a second end of greater diameter such that the first end of the conical portion having smaller diameter is directed towards the fiat portion and the second end of the conical portion having greater diameter is directed away from the flat portion, and which flat portion and the conical portion comprise refining surfaces provided with blade to bars and blade grooves therebetween.

The invention further relates to a blade segment of a refiner comprising a stator and a rotor, the stator and the rotor comprising a flat portion and a conical portion, the conical portion having a first end of smaller diameter and a second end of greater diameter such that the first end of the conical portion having smaller diameter is directed towards the flat portion and the second end of the conical portion having greater diameter is directed away from the flat portion, and which blade segment is configurable to form at least part of the refining surface of the conical portion of the stator and which blade segment comprises blade bars and blade grooves therebetween, which together form the refining surface of the blade segment.

Refiners for processing fibrous material typically comprise two, but possibly also more, oppositely situated refining surfaces, at least one of which is arranged to rotate about a shaft such that the refining surfaces turn relative to one another. The refining surfaces of the refiner, i.e. its blade surfaces or the blade set, typically consist of protrusions, i.e. blade bars, provided in the refining surface and blade grooves between the blade bars. Hereinafter, blade bars may also be referred to as bars and blade grooves as grooves. The refining surface often consists of a plural number of juxtaposed blade segments, in which case the refining surfaces of individual blade segments together form an integral, uniform refining surface.

2. Description of Related Art

WO 97/18037 discloses a refiner provided with a stator, i.e. a fixed, immobile refiner element, and a refiner element to be rotated by means of a shaft, i.e. a rotor. Both the stator with its refining surface and the rotor with its refining surface are formed of a flat portion substantially perpendicular to the rotor shaft and a conical portion provided after this fiat portion and arranged at an angle to the flat portion. The conical portion therefore has the first end of smaller diameter and the second end of greater diameter such that the first end of the conical portion having the smaller diameter is directed towards the flat portion of the refiner and the second end of the conical portion having the greater diameter is directed away from the flat portion of the refiner. The flat and conical portions of the stator and the rotor are spaced apart such that a blade gap is formed between the refining surface of the stator and the refining surface of the rotor. The fibrous material to be refined is fed into the blade gap between the fiat portions of the stator and the rotor. As the material to be refined is being processed, it moves forward in the blade gap between the refining surfaces of the flat portion and further into the blade gap between the refining surfaces of the conical portion and finally away from the blade gap.

FIG. 2 is a schematic view of a refining surface of a blade segment for a conical portion of a stator typically used in refiners as disclosed for example in WO 97/18037. The prior art blade segment 19 of FIG. 2 comprises a refining surface 12 having blade bars 20 and blade grooves 21 between the blade bars 20. Between the blade bars 20 there are also dams 26 distributed over the whole refining surface area. The blade bars 20 and the blade grooves 21 have a V-shaped form, making it possible to rotate a rotor of the refiner in both directions and still achieve the similar refining behaviour. The advantage of this is that the rotor of the refiner may be rotated freely in both directions. However, the present use of refiners promotes the rotation of the rotor only in one direction due to the energy consumption and blade set lifetime reasons. In result of this the V-shaped blade bar and blade groove form in the refining surface of the stator is problematic, because one half of the refining surface of the stator feeds the material to be refined out of the blade gap and the other half of the refining surface of the stator prevents the material to be refined moving out of the refiner, what leads to the unhomogeneous pulp quality. The variation of the intersecting angle of the V-shaped blade bars of the stator decreases the loading capacity of the refiner, thus preventing the effective utilization of the refiner.

BRIEF SUMMARY OF THE INVENTION

An object of the invention is a novel refiner providing improved pulp quality.

The refiner of the invention is characterized in that the refining surface of the conical portion of the stator comprises at least an outer zone arranged at the second end of the conical portion having greater diameter and an inner zone arranged relative to the outer zone on the side of the first end of the conical portion having smaller diameter, the length of the outer zone being half of the total length between the first end and the second end of the conical portion of the stator and that a portion of the length of the blade bars in the outer zone of the conical portion of the stator are arranged relative to the rotation direction of the rotor such that they have a retentive effect on the material to be refined and that this portion of the length of the blade bars in the outer zone of the conical portion of the stator corresponds to at least 10% of the total length between the first end and the second end of the conical portion of the stator.

A blade segment of the invention is characterized in that the blade segment comprises at least an outer zone arrangeable at the second end of the conical portion of the stator having greater diameter and an inner zone arrangeable relative to the outer zone on the side of the first end of the conical portion of the stator having smaller diameter, the length of the outer zone being half of the total length of the blade segment and that a portion of the length of the blade bars in the outer zone of the blade segment are arrangeable relative to the rotation direction of the rotor such that they have a retentive effect on the material to be refined and that this portion of the length of the blade bars in the outer zone of the blade segment corresponds to at least 10% of the total length of the blade segment.

The refiner comprises a stator and a rotor and the stator and the rotor comprise a flat portion and a conical portion. The conical portion has a first end of smaller diameter and a second end of greater diameter such that the first end of the conical portion having smaller diameter is directed towards the flat portion and the second end of the conical portion having greater diameter is directed away from the flat portion. The flat portion and the conical portion comprise refining surfaces provided with blade bars and blade grooves there between. The refining surface of the conical portion of the stator comprises at least an outer zone arranged at the second end of the conical portion having greater diameter and an inner zone arranged relative to the outer zone on the side of the first end of the conical portion having smaller diameter. The length of the outer zone is half of the total length between the first end and the second end of the conical portion of the stator. A portion of the length of the blade bars in the outer zone of the conical portion of the stator are arranged relative to the rotation direction of the rotor such that they have a retentive effect on the material to be refined and this portion of the length of the blade bars in the outer zone of the conical portion of the stator corresponds to at least 10% of the total length between the first end and the second end of the conical portion of the stator.

BRIEF DESCRIPTION OF THE SEVERAL VIEWS OF THE DRAWINGS

With the blade bars arranged relative to the rotation direction of the rotor such that they have a retentive effect on the material to be refined, in other words, retentive blade bars generally refer to a blade bar that produces in the mass particle to be refined a velocity component towards the first end of smaller diameter, i.e. towards the centre of the refiner. Because in this case the retentive blade bar portions are arranged in the conical portion of the stator, the retentive blade bar portions in practice produce no specific velocity component to the mass particle but they prevent the fibrous material to be refined from moving from the first end of smaller diameter towards the second end of greater diameter and finally away from the blade gap such that the speed of the movement of the fibrous material slows down at least on some part of the outer zone of the conical portion of the stator. This increases the amount of material to be refined in the blade gap, thus improving pulp quality and making the pulp to be refined more uniformly.

According to an embodiment of the invention the retentive blade bar portions are arranged in the outer zone of the conical portion of the stator such that the retentive blade bar portions create a negative blade bar angle relative to the rotation direction of the rotor in the outer zone of the conical portion of the stator.

According to an embodiment of the invention the retentive blade bar portions are arranged in the outer zone of the conical portion of the stator such that the retentive blade bar portions create a blade bar angle value between 0 degree to minus 30 degrees in the outer zone of the conical portion of the stator relative to the rotation direction of the rotor. The value of the blade bar angle makes it possible to affect the refining result in order to provide desired pulp quality.

BRIEF DESCRIPTION OF THE FIGURES

Figure 1:
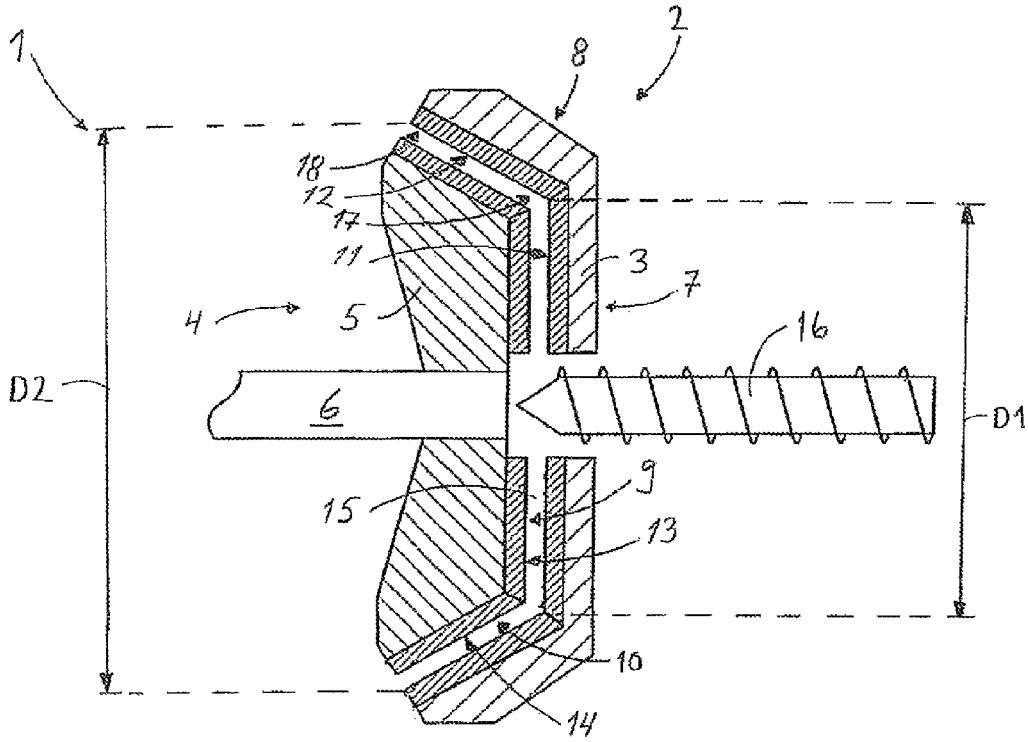
Figure 4:
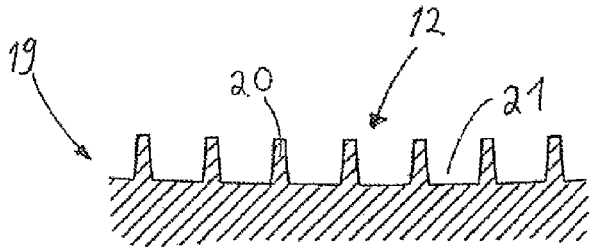
Figure 2:
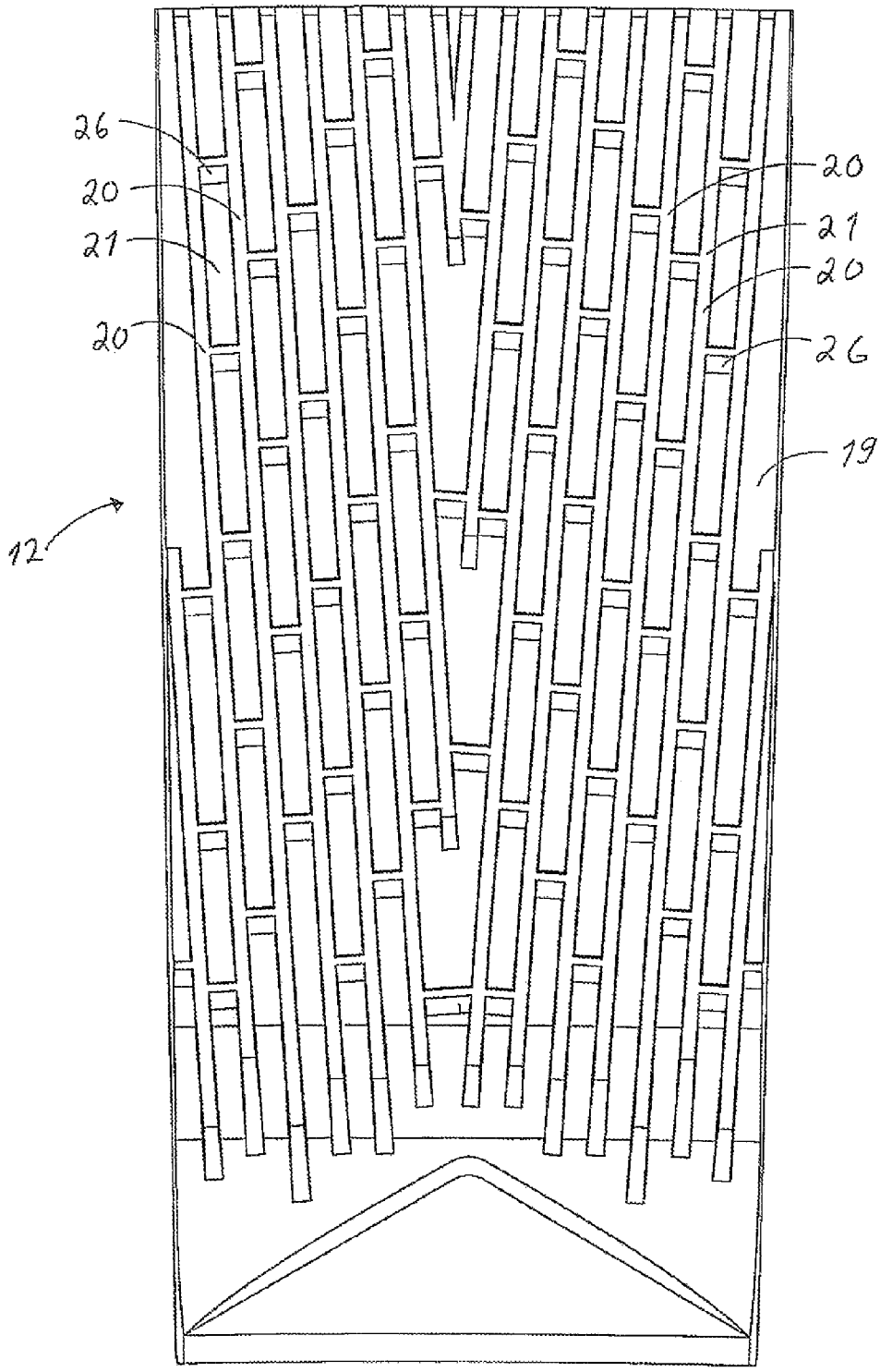
PRIOR ART FIG. 2
Figure 3:
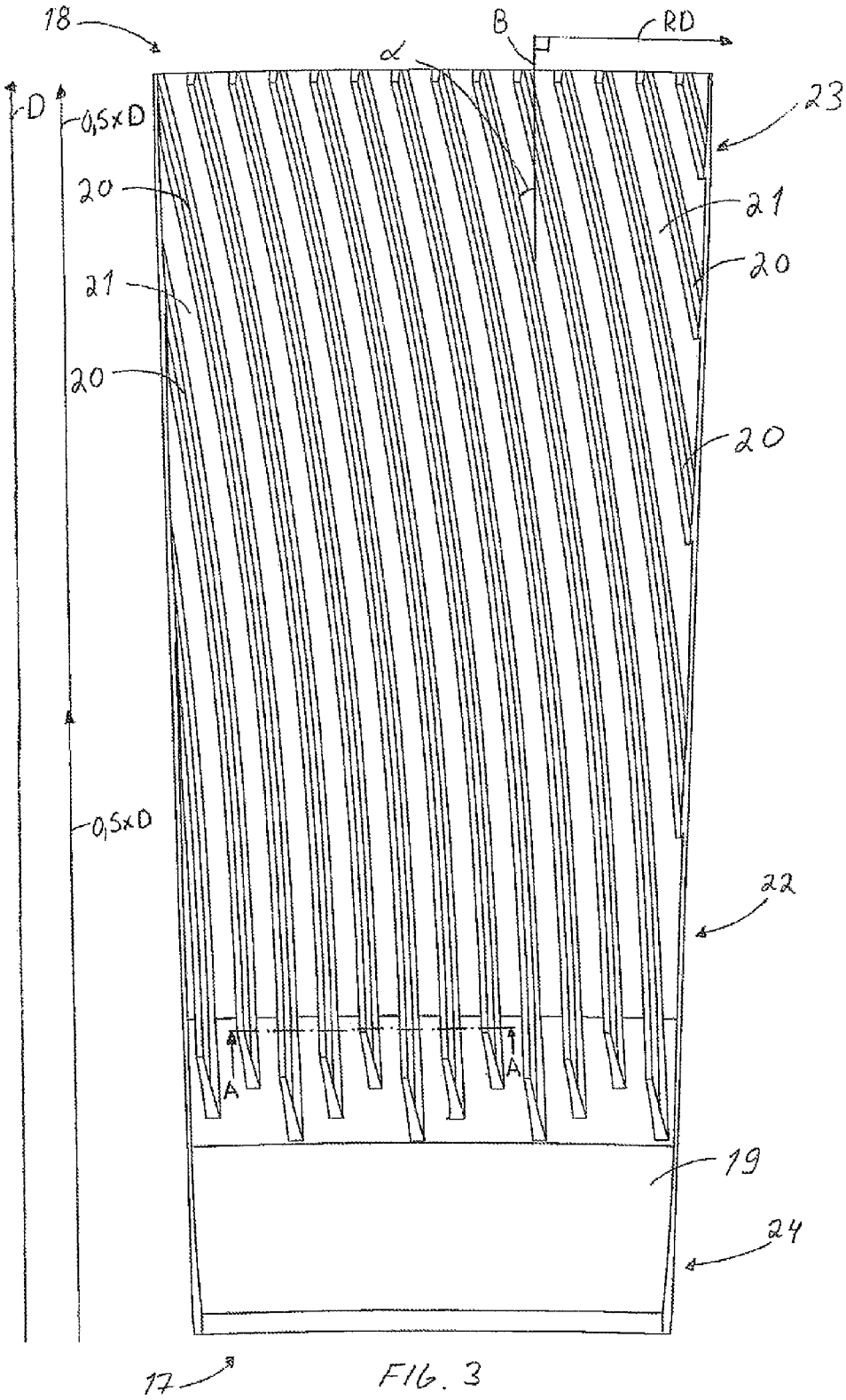
Figure 5:
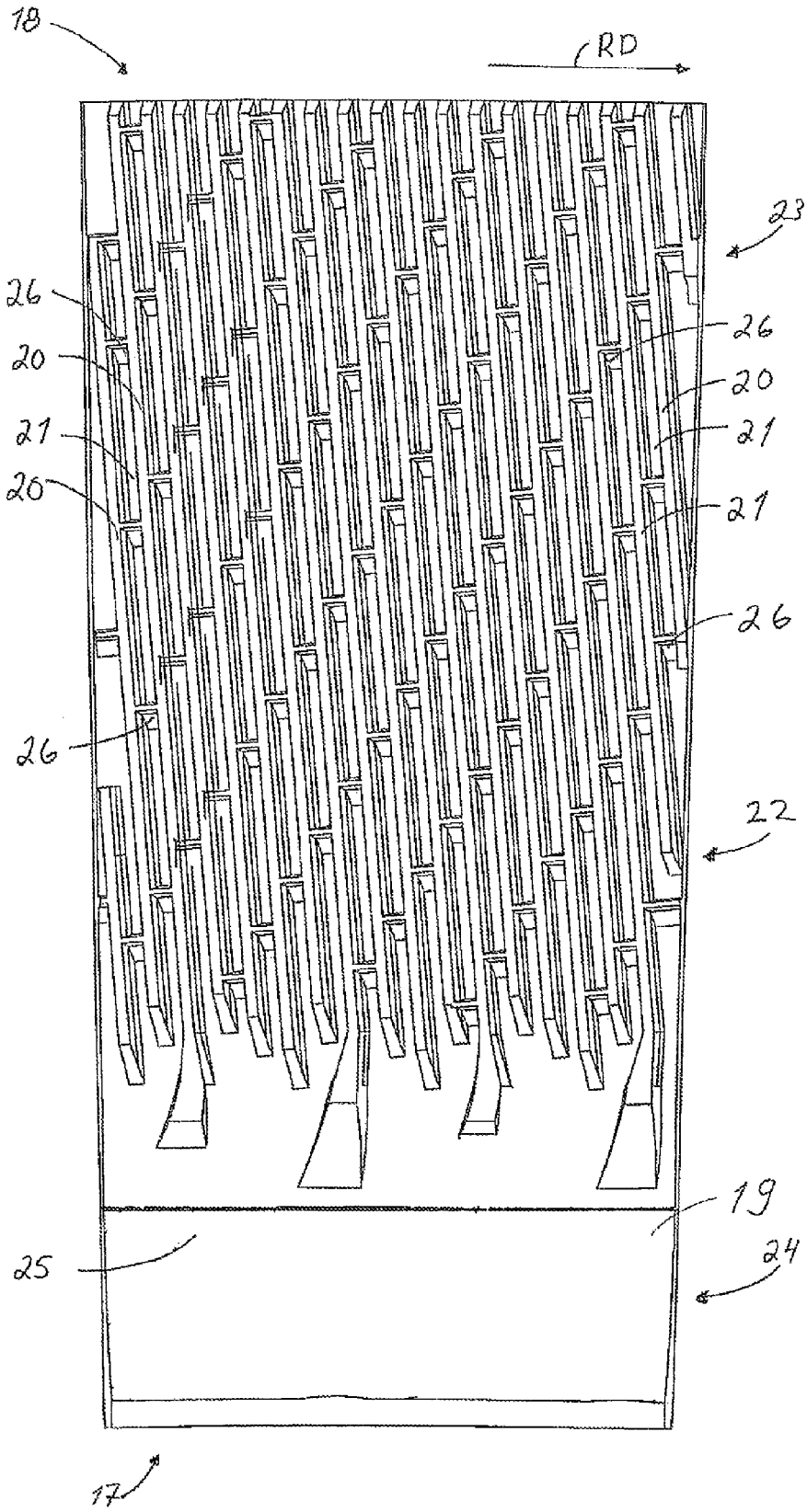
Figure 6:
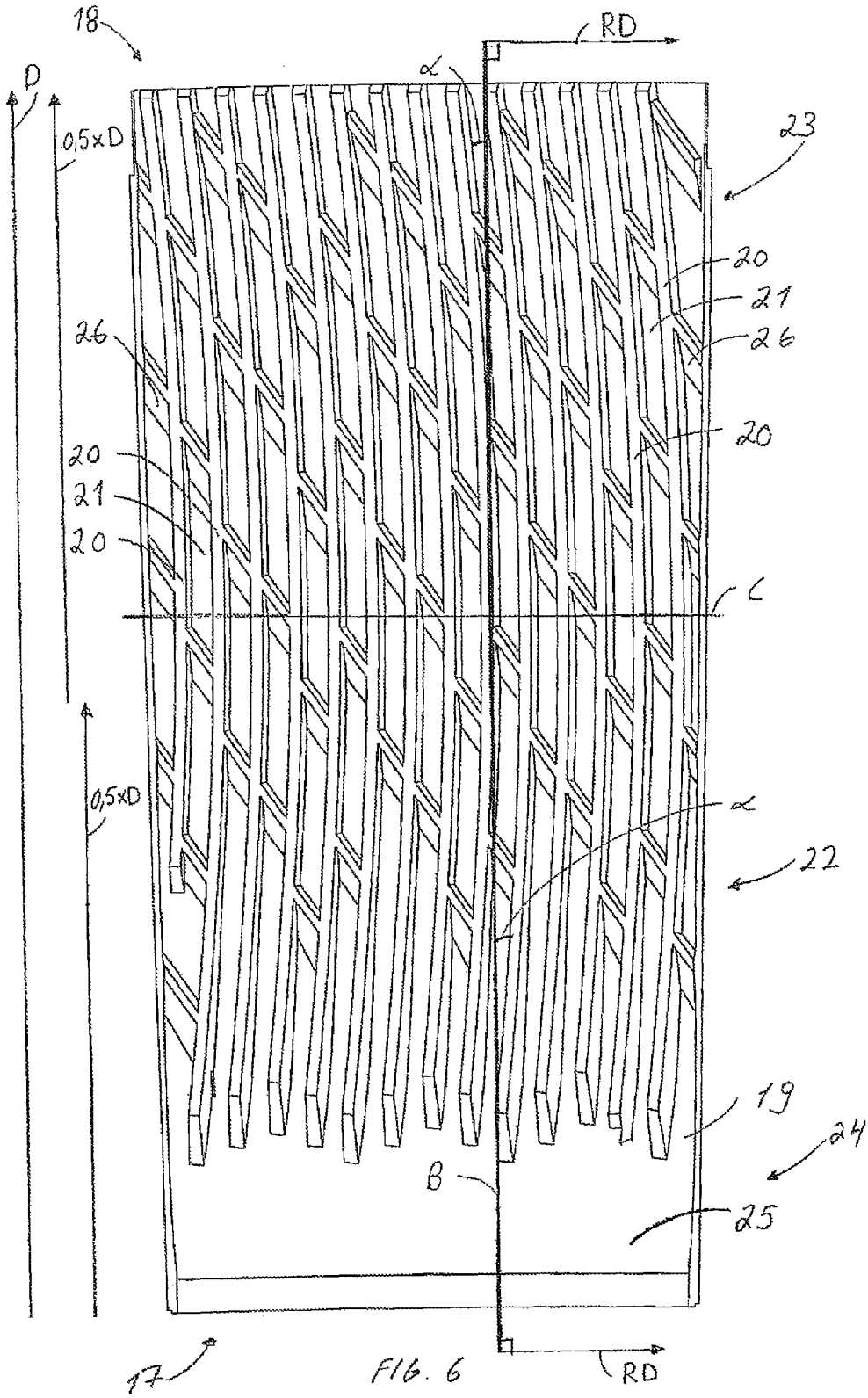

Some embodiments of the invention will be discussed in greater detail with reference to the accompanying figures, in which FIG. 1 is a schematic view of a refiner in which the disclosed solution of a refining surface can be applied;

FIG. 2 is a schematic view of a refining surface of a prior art blade segment for a conical portion of a stator;

FIG. 3 is a schematic view of a blade segment of a conical portion of a stator;

FIG. 4 is a schematic cross-sectional view of a blade segment according to FIG. 3;

FIG. 5 is a schematic view of a second blade segment of a conical portion of a stator;

FIG. 6 is a schematic view of a third blade segment of a conical portion of a stator.

For the sake of clarity, some embodiments of the invention are simplified in the Figures. Like parts are indicated with like reference numerals.

DETAILED DESCRIPTION OF THE INVENTION

FIG. 1 is a schematic view of a refiner 1 for refining fibrous material. The refiner 1 is provided with a fixed stator 2, supported to a frame of the refiner 1 not shown in FIG. 1. The stator 2 comprises a frame part 3 of the stator 2 and a refining surface consisting of blade bars and blade grooves, i.e. a stator blade or blade set. Further, the refiner 1 is provided with a rotor 4 comprising a frame part 5 of the rotor 4 and a refining surface consisting of blade bars and blade grooves, i.e. a rotor blade or blade set. The rotor 4 is arranged to be rotated by a shaft 6 and a motor, not shown. The stator 2 comprises a flat portion 7 and a conical portion 8. The rotor 4 comprises correspondingly a flat portion 9 and a conical portion 10. The fiat portions 7 and 9 are arranged substantially perpendicularly to the shaft 6 and the conical portions 8 and 10 are arranged at a predetermined angle to the flat portions 7 and 9. The conical portion of the refiner 1 has therefore the a first end 17 of smaller diameter D1 and a second end 18 of greater diameter D2 such that the first end 17 of the conical portion having smaller diameter D1 is directed towards the fiat portion and the second end 18 of the conical portion having greater diameter D2 is directed away from the flat portion. The first end 17 of the conical portion having smaller diameter D1 may also be called an inner circumference of the conical portion and the second end 18 of the conical portion having greater diameter D2 may also be called an outer circumference of the conical portion. The diameters D1 and D2 have been schematically drawn in FIG. 1 at the outermost points of the corresponding refining surfaces of the flat and conical portions of the stator.

The flat portion 7 of the stator 2 comprises a refining surface 11 and the conical portion 8 of the stator 2 comprises a refining surface 12. The flat portion 9 of the rotor 4 comprises a refining surface 13 and the conical portion 10 of the rotor 4 comprises a refining surface 14. The rotor 4 is arranged at a distance from the stator 2 in such a way that a blade gap 15 is left between the refining surfaces of the rotor 4 and the refining surfaces of the stator 2. The size of the blade gap 15 may typically be adjusted separately on the flat portion and the conical portion. The fibrous material to be refined is fed by means of a feed screw 16, for example, through the centre of the flat portions 7 of the refining surfaces 11 of the stator 2 to the blade gap 15, where the fibrous material is refined and, at the same time, it moves between the flat portion 7 of the refining surface 11 of the stator 2 and the flat portion 9 of the refining surface 13 of the rotor 4 towards a portion between the conical portions 8, 10 in the blade gap 15 and finally away from the blade gap 15. A person skilled in the art is familiar with the general structure and operating principle of refiners and therefore they are not discussed further in this context.

FIG. 3 is a schematic view of a blade segment 19 for the conical portion 8 of the stator 2, the blade segment 19 intended to form part of the integral refining surface 12 of the conical portion 8 of the stator 2. FIG. 4 is a schematic cross-sectional view of the blade segment 19 according to FIG. 3. The refining surface 12 comprises blade bars 20 and blade grooves 21 between the blade bars 20. The blade bars 20 take care of refining the fibrous material to be refined and the blade grooves 21 carry forward the fibrous material to be refined as well as the refined material and also take care of conveying the steam or vapour created during the refining away from the blade gap 15.

The blade segment 19 of FIG. 3 comprises an outer zone 23 to be arranged at the second end 18 of the conical portion 8 of the stator 2 having greater diameter D2 and an inner zone 22 to be arranged relative to the outer zone 23 on the side of the first end 17 of the conical portion 8 of the stator 2 having smaller diameter D1. The length of the outer zone 23 is half of the total length D of the blade segment 19, i.e. 0.5×D. In other words, the length of the outer zone 23 is half of the total length D between the first end 17 and the second end 18 of the conical portion 8 of the stator 2. As the refining of the fibrous material proceeds, the material to be refined moves forward from the inner zone 22 to the outer zone 23. The blade bars 20 are configured as continuous blade bars travelling continuously in a curved shape from the first end 17 of the conical portion 8 having smaller diameter to the second end 18 of the conical portion 8 having the greater diameter. In other words, the blade bars 20 are configured as continuous blade bars travelling continuously in a curved shape from the inner periphery of the blade segment 19 to the outer periphery of the blade segment 19. The extreme end of the refining surface 12 of the conical portion 8 of the stator 2 on the side of the first end 17 of the conical portion 8 is provided with a transition zone 24 having no blade bars and having feeding elements is arranged to allow the movement of the material to be refined from the flat portion 7 of the stator 2 to the conical portion 8 of the stator 2. One type of transition zone is presented for example in the FIGS. 5 and 6 in WO 97/18037. It is also possible that the blade segment 19 does not comprise any transition zone 24, but the inner zone 22 comprises the whole length of the conical portion 8 of the stator 2 between the first end 17 of the conical portion 8 having smaller diameter D1 and the outer zone 23.

All the blade bars 20 of the blade segment 19 according to FIG. 3 are configured as retentive blade bars. In other words the blade bars 20 are configured in the conical portion 8 of the stator 2 such that they have a retentive effect on the material to be refined. This retentive effect means that the blade bars 20 in the conical portion 8 of the stator 2 are configured to prevent the fibrous material to be refined from moving from the first end of smaller diameter towards the second end of greater diameter. This means that the blade bars 20 in the conical portion 8 of the stator 2 slow down the speed of the movement of the material to be refined from the first end of smaller diameter towards the second end of greater diameter, or in other words, from the inner circumference of the conical portion 8 of the stator 2 to the outer circumference of the conical portion 8 of the stator 2.

This effect is provided by configuring the blade bars 20 of the conical portion 8 of the stator 2 such that the blade bars 20 of the refining surface 12 of the conical portion 8 of the stator 2 are directed into the opposite direction relative to the rotation direction RD of the rotor 4. This kind of configuration means that there is a specific blade bar angle α between the blade bars 20 of the conical portion 8 of the stator 2 and a line B (partly shown in FIG. 3) running parallel with respect to the refining surface 12 of the conical portion 8 of the stator 2 from the direction of the first end 17 of the conical portion 8 towards the direction of the second end 18 of the conical portion 8 and being right-angled or perpendicular relative to the arrow RD indicating the rotation direction of the rotor 4, as schematically shown in FIG. 3. The direction of the blade bar angle α between the retentive blade bar of the stator and the line B described above is opposite to the rotation direction RD of the rotor. The blade bar angle having the direction indicated above has therefore a negative blade bar angle α relative to the rotation direction RD of the rotor 4. The size of this blade bar angle may be 0 to −30, i.e. 0 degree to minus 30 degrees. The blade bar angle α may also be −1 to −20 degrees, i.e. minus 1 to minus 20 degrees or even −2 to −10 degrees, i.e. minus 2 to minus 10 degrees. This blade bar angle α may change in the direction of travel of the blade bar 20.

The retentive effect on the material to be refined means, in practice, that the blade bars 20 of the refining surface 12 of the conical portion 8 of the stator 2 slow down the movement of the fibrous material to be refined from the first end 17 of smaller diameter of the conical portion towards the second end 18 of greater diameter of the conical portion and finally away from the blade gap 15. Because the residence time, i.e. the time the material to be refined stays between the refining surfaces of the conical portions of the stator 2 and the rotor 4 increases, the degree of grinding increases. This means that the refining effect on the material to be refined increases, thus improving pulp quality and making pulp to be refined more uniformly. Because all the blade bars 20 in the outer zone 23 of the conical portion 8 of the stator 2 are arranged to have a retentive effect on the material to be refined, the outer zone 23 of the conical portion 8 of the stator 2 provides shearing force having a parallel effect on the material to be refined on the whole refining surface area of the outer zone 23, this resulting in the flow of field of the material to be refined being more uniform than before. This provides a uniform degree of grinding on the material to be refined, thus providing a uniform and high quality of the refined material.

FIG. 5 is a schematic view of a second blade segment 19 for the conical portion 8 of the stator 2, the blade segment 19 intended to form part of the integral refining surface 12 of the conical portion 8 of the stator 2. The blade segment 19 of FIG. 5 comprises an outer zone 23 to be arranged at the second end 18 of the conical portion 8 having greater diameter and an inner zone 22 to be arranged relative to the outer zone 22 on the side of the first end 17 of the conical portion 8 having smaller diameter. The blade bars 20 are configured as continuous blade bars travelling continuously in a straight shape from the first end 17 of the conical portion 8 having smaller diameter to the second end 18 of the conical portion 8 having the greater diameter. All the blade bars 20 of the blade segment 19 according to FIG. 5, too, are configured as retentive blade bars, i.e. they are directed in the opposite direction relative to the rotation direction RD of the rotor 4. The extreme end of the refining surface 12 of the conical portion 8 of the stator 2 on the side of the first end 17 of the conical portion 8 is also provided with a transition zone 24.

The refining surface 12 of the blade segment 19 is also provided with dams 26 arranged between two blade bars 20 to break the blade groove 21 between the two blade bars 20. The task of the dam 26 is to lift or transfer the material to be refined and moving in the blade grooves 21 between the blade bars 20 of the stator 2 and the rotor 4 so that the refining effect on the material to be refined will increase.

FIG. 6 is a schematic view of a third blade segment 19 for the conical portion 8 of the stator 2, the blade segment 19 intended to form part of the integral refining surface 12 of the conical portion 8 of the stator 2. The blade segment 19 of FIG. 6 comprises an outer zone 23 to be arranged at the second end 18 of the conical portion 8 having greater diameter and an inner zone 22 to be arranged relative to the outer zone 23 on the side of the first end 17 of the conical portion 8 having smaller diameter. The extreme end of the refining surface 12 of the conical portion 8 of the stator 2 on the side of the first end 17 of the conical portion 8 is also provided with a transition zone 24.

The blade bars 20 in FIG. 6 are configured as continuous blade bars travelling continuously in a curved shape from the first end 17 of the conical portion 8 having smaller diameter to the second end 18 of the conical portion 8 having the greater diameter. All the blade bars 20 are configured on the outer zone 23 of the blade segment 19 such that about 85% of the length of the blade bars 20 in the area of the outer zone 23 of the blade segment 19 comprise retentive blade bar portions. This means that about 43% of the total length of the blade bars 20 comprise retentive blade bar portions, these retentive blade bar portions being located in the area of the outer zone 23, whose length is half of the total length D of the blade segment 19 or, in other words, half of the total length D of the conical portion 8 of the stator 2.

According to the solution, a portion of the length of the blade bars 20 in the outer zone 23 of the conical portion 8 of the stator 2 are arranged relative to the rotation direction RD of the rotor 4 such that they have a retentive effect on the material to be refined, this portion of the corresponding to at least 10%, and in some cases, at least 30% of the total length D between the first end 17 and the second end 18 of the conical portion of the stator 2. These retentive blade bar portions may be at any location in the area of the outer zone 23 in the length direction of the conical portion of the stator. So, they do not necessarily need to be located in the outer zone 23 such that they are immediately at the second end 18 of the conical portion 8 of the stator 2. The retentive effect of the retentive blade bar portions is the higher the closer the retentive blade bar portions are of the second end of the conical portion of the stator having greater diameter.

All the blade bars 20 are configured on the inner zone 22 of the blade segment 19 such that all the blade bars 20 on the inner zone 22 of the blade segment 19 are feeding blade bars. By feeding blade bars of the stator it is referred to the blade bars of a stator arranged relative to the rotation direction RD of the rotor 4 such that they have a feeding effect on the material to be refined. A blade bar having a feeding effect on the material to be refined generally refers to a blade bar that produces in the mass particle to be refined a velocity component toward the second end of greater diameter, i.e. away from the centre of the refiner. Because in this case the feeding blade bar portions are arranged in the stator, in practice the blade bars on the inner zone 22 of the conical portion 8 of the stator 2 produce no specific velocity component to the mass particle, but they allow or enhance the movement of the fibrous material to be refined from the first end 17 of smaller diameter towards the second end 18 of greater diameter.

The blade bar portions of the blade bars 20 on the inner zone 22 of the conical portion 8 of the stator 2 are directed in the corresponding direction relative to the rotation direction RD of the rotor 4. This kind of configuration means that there is a specific positive blade bar angle $\alpha$ between the blade bars 20 of the conical portion 8 of the stator 2 and the rotation direction RD of the rotor 4, as schematically shown in FIG. 6. In other words, this means that the direction of the blade bar angle $\alpha$ is corresponding to the rotation direction RD of the rotor 4 on the inner zone 22 of the conical portion 8 of the stator 2 and opposite to the direction of the blade bar angle $\alpha$ on the outer zone 23.

The line C shown schematically in FIG. 6 depicts the point where the blade bars 20 approximately change from being feeding blade bars, i.e. having a positive blade bar angle relative to the rotation direction of the rotor, to being retentive blade bars, i.e. having a negative blade bar angle relative to the rotation direction of the rotor. The above described blade bar angle is at this point 0 degree. Therefore in FIG. 6 it can be seen that the blade bars 20 can have in the area of the outer zone 23 also portions having a feeding effect on the material to be refined.

The feeding effect on the material to be refined means, in practice, that the blade bars 20 on the inner zone 22 of the conical portion 8 of the stator 2 enhance the movement of the fibrous material to be refined from the inner zone 22 of the blade segment 19 towards the outer zone 23 of the blade segment 19. This means that the refining effect on the material to be refined may be reduced on the inner zone 22 of the refining surface 12. The feeding blade bar portions in the inner zone 22 provide a shorter residence time of the material to be refined in the blade gap. They also create more turbulence in the material to be refined. These both phenomena save the energy used in the refining. The energy saving originates form the fact that the blade gap is smaller in the outer zone of the conical portion of stator than in the inner zone of the conical portion of the stator. This means that the refining is more efficient in the area of the outer zone than in the area of the inner zone. When the refining takes place mainly in the outer zone, the energy used in the refining can be reduced. Therefore the intensifying of the feeding of the material to be refined from the inner zone towards the outer zone can result in energy saving without any effect on the pulp quality.

The refining surface 12 of the blade segment 19 according to FIG. 6 is also provided with dams 26 arranged between two blade bars 20 to break the blade groove 21 between the two blade bars 20.

According to an embodiment the length of the inner zone 22 may correspond to at least one-quarter of the total length between the first end 17 and the second end 18 of the conical portion 8 of the stator 2 such that the inner zone 22 is located at some portion of the conical portion (8) of the stator 2 between the first end 17 of the conical portion 8 having a smaller diameter D1 and the outer zone 23 and that the blade bars 20 are feeding blade bars in the inner zone 22. According to an embodiment the length of the inner zone 22 corresponds to half of the total length between the first end 17 and the second end 18 of the conical portion 8 of the stator 2 such that there is no special transition zone 24 at all and that the blade bars 20 are feeding blade bars in the inner zone 22. The feeding effect of the feeding blade bar portions is the higher the closer the feeding blade bar portions are of the first end of the conical portion of the stator having smaller diameter.

The above-described refining surfaces may be used in the cortical portion of the stator both in the high-consistency refiners and low-consistency refiners. High-consistency refiners may be used both as a first-phase refiner for refining wood chips and as a second-phase refiner or other refiner for further refining wood chips already refined or fibre pulp or another fibre containing material. In high-consistency refiners the consistency of the material to be refined is typically over 25% or 30%. Because of the high consistency the flow of to the material to be refined and the flow of the material refined take place in steam or vapour phase in high-consistency refiners. Because the blade gap on the outer zone of the conical portion of the stator in high-consistency refiners is full of steam, steam will flow away from the blade gap out of the refiner very easily and at a high speed, carrying a lot of fibres out of the blade gap at the same time. Due to the retentive effect of the blade bars at least in the outer zone of the conical portion of the stator the fibres will stay a longer time in the blade gap, thus increasing the grinding effect on the material to be refined. Therefore, the improvement in the functionality of the refining, i.e. high production capacity, a remarkable increase in the degree of grinding and better pulp characteristic of fibre pulp are significant in high-consistency refiners.

As already mentioned, the above-described refining surfaces may also be used in the conical portion of the stator in low-consistency refiners. In low-consistency refiners the consistency of the material to be refined is typically less than 8% and often less than 5%. Because of the low consistency the flow of the material to be refined and the flow of the material refined in low-consistency refiners takes place mainly in liquid phase comprising water and fibres, the amount of steam being minimal. Typically there is no steam at all.

The size of the blade gap in the high-consistency refiners is bigger than in the low-consistency refiners. Because of the bigger blade gap and the high consistency the amount of material to be refined is bigger in the high-consistency refiners than in the low-consistency refiners. This means that the treatment of fibres takes place in high-consistency refiners more due to fibre-fibre contact than in low-consistency refiners, the fibre-fibre contact increasing the degree of grinding. Because of these characteristics the amount of energy used for refining is higher in the high-consistency refiners than in the low-consistency refiners, which means that a lot of steam is created during refining in the high-consistency refiners. Because of this steam the grinding in high-consistency refiners requires a larger flow volume than in the low-consistency refiners, wherein the grinding takes place in liquid phase comprising water and fibres. Due to the preventive blade bar portions the present solution provides a substantially same flow volume for the steam as in the prior art solution comprising V-shaped blade bars and blade grooves such that the steam flows in the blade gap of the present solution substantially at a same speed as in the prior art solution. However, the retentive blade bar portions prevent the flow of material to be refined more effectively and more even than the V-shaped blade bars. This means that more fibres remain in the blade gap, the load capacity of the refiner increases and fibre material having homogeneous quality can be obtained. The effect of the present solution has the same advantages in the low-consistency refiners. However, the advantages of the use of the present solution of a refining surface are emphasized in the high-consistency refiners, wherein the grinding takes place in the steam phase. The retentive blade bar portions prevent the flow of fibres such that more fibres remain in the blade gap for refining when the steam exits from the blade gap. In low-consistency refiners fibres flow with water and the present solution prevents the flow of both fibres and water out of the blade gap. Therefore more fibres remain in the blade gap for refining in the low-consistency refiners too, but the separation of fibre material and water does not happen in low-consistency refiners, as happens the separation of fibre material and steam in the high-consistency refiners.

The rotation speed of the rotor in the high-consistency refiners is also much higher than in the low-consistency refiners. The higher circumferential speed of the rotor in high-consistency refiners affect the grinding in high-consistency refiners such that the number of the impacts to the material to be refined by the blade bars is much higher in the high-consistency refiners than in the low-consistency refiners. Partly because of this the high-consistency refiner may be loaded more than the low-consistency refiners. The high loading means that a lot of energy may be used for refining, this, however, resulting in high steam amount and need for large flow volume for steam. The retentive blade bar portions slow down the movement of the material to be refined in the blade gap, thus increasing the load capacity of the refiner. The retentive blade bar portions prevent the flow of fibres but allow the flow of steam out of the blade gap, because the flow of steam is mainly affected by the open flow area. Also in this case, the advantages of the use of the present solution of a refining surface are emphasized in the high-consistency refiners, wherein the grinding takes place in the steam phase. The retentive blade bar portions prevent the flow of fibres such that more fibres remain in the blade gap for further refining when the steam exits from the blade gap. In low-consistency refiners fibres flow with water and the present solution prevents the flow of both fibres and water out of the blade gap such that more fibres remain in the blade gap. Therefore more fibres remain in the blade gap for further refining than in prior art solution.

The above-described refining surfaces may also be similarly used in the conical portion of the stator of medium-consistency refiners where the consistency of the material to be refined is typically between 8% and 25%.

In some cases the features disclosed in the present application may be used as such, irrespective of the other features. On the other hand, the features disclosed in this application may be combined to produce different combinations, when necessary.

The drawings and the related specification are only intended to illustrate the inventive idea. The details of the invention may vary within the scope of the claims. In all the presented embodiments the blade bars are running continuously from the inner zone of the blade segment to the outer zone of the blade segment such that the blade bar angle between the portion of the blade bar in the outer zone and the rotation direction of the rotor is negative. It is also possible, however, that there are blade bars separate of each other on the inner zone and the outer zone. It is also possible that the inner zone 22 of the refining surface 12 of the conical portion 8 of the stator 2 comprises blade bars 20 and blade grooves 21 having a V-shaped form.

Further, as the outer zone of the conical portion of the stator comprises blade bars such that a portion of the length of the blade bars on the outer zone have a retentive effect on the material to be refined, the rest of the refining surface can comprise several refining surface zones comprising retentive, feeding or even V-shaped blade bars.

On the inner part of the refining surface, i.e. outside of the area of the outer zone 23 of the refining surface of the conical portion 8 of the stator 2, the blade bars and blade grooves may be arranged to form several refining zones for example such that, when seeing towards the second end of the conical portion of the stator, after the transition zone the blade bars may be arranged to have a feeding effect on the material to be refined. After this kind of feeding zone it is possible to provide a refining zone comprising straight blade bars and blade grooves having a retentive effect. After this kind of retentive zone it is still possible to provide another refining zone having a feeding effect on the material to be refined before the material to be refined proceeds to the outer zone 23 of the conical portion 8 of the stator 2. With this kind of refining surface solution it is possible to provide on the inner part of the refining surface of the conical portion of the stator a flow of material to be refined containing a strong turbulence effect on the material to be refined and, at the same time, to provide on the material to be refined a strong feeding effect towards the outer zone 23 of the conical portion 8 of the stator 2.

As seen in FIGS. 3 and 6, the direction of the blade bars and blade grooves change very smoothly, when the blade bars and blade grooves travel from the inner zone 22 of the conical portion of the stator 2 to the outer zone 23 of the conical portion 8 of the stator 2. It is, however, possible that there is an instant or immediate, abrupt change in the direction of the travel of the blade bars and blade grooves at the transitional point between the inner zone 22 and the outer zone 23, when the blade bars and blade grooves travel from the inner zone 22 to the outer zone 23. It is also possible that the abrupt change in the direction of the travel of the blade bars and blade grooves at the transitional point between the inner zone 22 and the outer zone 23 is not provided with an immediate change but with a change of short length.

The invention claimed is:

1. A refiner (1) comprising a stator (2) and a rotor (4), the stator (2) and the rotor (4) comprising a flat portion (7, 9) and a conical portion (8, 10), the conical portion (8) having a first end (17) of smaller diameter (D1) and a second end (18) of greater diameter (D2) such that the first end (17) of the conical portion (8, 10) having smaller diameter (D1) is directed towards the flat portion (7, 9) and the second end (18) of the conical portion (8, 10) having greater diameter (D2) is directed away from the flat portion (7, 9), and which flat portion (7, 9) and the conical portion (8, 10) comprise refining surfaces (11, 12, 13, 14) provided with blade bars (20) and blade grooves (21) therebetween, and that the refining surface (12) of the conical portion (8) of the stator (2) comprises at least an outer zone (23) arranged at the second end (18) of the conical portion (8) having greater diameter (D2) and an inner zone (22) arranged relative to the outer zone (23) on the side of the first end (17) of the conical portion (8) having smaller diameter (D1), the length of the outer zone (23) being half of the total length (D) between the first end (17) and the second end (18) of the conical portion (8) of the stator (2) and that a portion of the length of the blade bars (20) in the outer zone (23) of the conical portion (8) of the stator (2) create a negative blade bar angle (α) having a value of minus 1 degree to minus 30 degrees relative to the rotation direction (RD) of the rotor (4) such that they have a retentive effect on the material to be refined and that this portion of the length of the blade bars (20) in the outer zone (23) of the conical portion (8) of the stator (2) corresponds to at least 10% of the total length (D) between the first end (17) and the second end (18) of the conical portion (8) of the stator (2).

2. A refiner according to claim 1, wherein the portion of the length of the blade bars (23) in the outer zone (23) of the conical portion (8) of the stator (2), which portion of the length of the blade bars (23) creates a negative blade bar angle (α) having a value of minus 1 degree to minus 30 degrees relative to the rotation direction of the rotor (4), corresponds to at least 30% of the total length between the first end (17) and the second end (18) of the conical portion (8).

3. A refiner according to claim 1, wherein the length of the blade bars (20) of the conical portion (8) of the stator (2), which blade bars (20) create a negative blade bar angle (α) having a value of minus 1 degree to minus 30 degrees relative to the rotation direction (RD) of the rotor (4), correspond to the total length between the first end (17) and the second end (18) of the conical portion (8).

4. A refiner according to claim 1, wherein the blade bar angle (α) has a value of minus 1 degree to minus 20 degrees relative to the rotation direction (RD) of the rotor (4).

5. A refiner according to claim 1, wherein the blade bar angle (α) has a value of minus 2 degrees to minus 10 degrees relative to the rotation direction (RD) of the rotor (4).

6. A refiner according to claim 1, wherein the blade bars (20) are arranged in the inner zone (22) of the conical portion (8) of the stator (2) such that the blade bars create a negative blade bar angle (α) relative to the rotation direction (RD) of the rotor (4) in the inner zone (22) of the conical portion (8) of the stator (2).

7. A refiner according to claim 1, wherein the blade bars (20) are arranged in the inner zone (22) of the conical portion (8) of the stator (2) such that the blade bars create a positive blade bar angle (α) relative to the rotation direction (RD) of the rotor (4) in the inner zone (22) of the conical portion (8) of the stator (2).

8. A refiner according to claim 7, wherein the length of the inner zone (22) corresponds to at least one-quarter of the total length between the first end (17) and the second end (18) of the conical portion (8) of the stator (2), the inner zone (22) being located at some portion of the conical portion (8) of the stator (2) between the first end (17) of the conical portion (8) having a smaller diameter (D1) and the outer zone (23).

9. A refiner according to claim 8, wherein the length of the inner zone (22) corresponds to half of the total length between the first end (17) and the second end (18) of the conical portion (8) of the stator (2).

10. A refiner according to claim 1, wherein the refiner (1) is a high-consistency refiner.

11. A blade segment (19) of a refiner (1), the blade segment (19) comprising:

blade bars (20) and blade grooves (21) therebetween, which together form a refining surface (12) of a conical portion (8) of a stator (2) of the refiner (1);

an outer zone (23) arrangeable at a second end (18) of the conical portion (8), the second end (18) having a diameter (D2); and an inner zone (22) arrangeable relative to the outer zone (23) on the side of a first end (17) of the conical portion (8), the first end (17) having a diameter (D1) smaller than the diameter (D2) of the second end (18), the length of the outer zone (23) being half of a total length (D) of the blade segment (19), wherein:

a portion of a length of the blade bars (20) in the outer zone (23) of the blade segment (19) are arrangeable to create a negative blade bar angle (α) having a value of minus 1 degree to minus 30 degrees relative to the rotation direction (RD) of the rotor (4) such that they have a retentive effect on the material to be refined; and the portion of the length of the blade bars (20) in the outer zone (23) of the blade segment (19) corresponds to at least 10% of the total length (D) of the blade segment (19).

12. A blade segment according to claim 11, wherein the portion of the length of the blade bars (20) in the outer zone (23) of the conical portion (8) of the stator (2), which portion of the length of the blade bars (20) creates a negative blade bar angle (α) having a value of minus 1 degree to minus 30 degrees relative to the rotation direction (RD) of the rotor (4), corresponds to at least 30% of the total length of the blade segment (19).

13. A blade segment according to claim 11, wherein the length of the blade bars (20) of the blade segment (19), which blade bars (20) are arrangeable to create a negative blade bar angle (α) having a value of minus 1 degree to minus 30 degrees relative to the rotation direction (RD) of the rotor (4), correspond to the total length of the blade segment (19).

14. A blade segment according to claim 11, wherein the blade bar angle (α) has a value of minus 1 degree to minus 20 degrees relative to the rotation direction (RD) of the rotor (4).

15. A blade segment according to claim 11, wherein the blade bar angle ($\alpha$) has a value of minus 2 degrees to minus 10 degrees relative to the rotation direction (RD) of the rotor (4).

16. A blade segment according to claim 11, wherein the blade bars (20) are arranged in the inner zone (22) of the blade segment (19) such that the blade bars are (22) arrangeable to create a negative blade bar angle ($\alpha$) relative to the rotation direction (RD) of the rotor (4) in the inner zone (22) of the conical portion (8) of the stator (2).

17. A blade segment according to claim 11, wherein the blade bars (20) are arranged in the inner zone (22) of the blade segment (19) such that the blade bars (20) are arrangeable to create a positive blade bar angle ($\alpha$) relative to the rotation direction (RD) of the rotor (4) in the inner zone (22) of the conical portion (8) of the stator (2).

18. A blade segment according to claim 17, wherein the length of the inner zone (22) corresponds to at least one-quarter of the total length of the blade segment (19), the inner zone (22) being located at some portion of the blade segment (19) between the inner periphery of the blade segment (19) and the outer zone (23) of the blade segment (19).

19. A blade segment according to claim 18, wherein the length of the inner zone (22) corresponds to half of the total length between the first end (17) and the second end (18) of the conical portion (8) of the stator (2).

* * * * *

UNITED STATES PATENT AND TRADEMARK OFFICE

CERTIFICATE OF CORRECTION

PATENT NO. : 8,226,023 B2
APPLICATION NO. : 12/679628
DATED : July 24, 2012
INVENTOR(S) : Vuorio et al.

It is certified that error appears in the above-identified patent and that said Letters Patent is hereby corrected as shown below:

Column 1

Line 21, “fiat” should read --flat--

Line 57, “fiat” should read --flat--

Column 4

Line 27, “fiat” should read --flat--

Line 33, “fiat” should read --flat--

Signed and Sealed this
Eighteenth Day of December, 2012

David J. Kappos

David J. Kappos
*Director of the United States Patent and Trademark Office*